United States Patent [19]

Addleman

[11] Patent Number: 4,744,840

[45] Date of Patent: May 17, 1988

[54] METHOD FOR SEALING CONTROLLED-ATMOSPHERE STORAGE ROOM

[75] Inventor: Michael J. Addleman, Cashmere, Wash.

[73] Assignee: Bethlehem Construction Co., Inc., Cashmere, Wash.

[21] Appl. No.: 931,347

[22] Filed: Nov. 17, 1986

[51] Int. Cl.[4] ..... E04B 1/66; E04B 2/04

[52] U.S. Cl. ..... 156/71; 52/265; 220/462; 220/467

[58] Field of Search ..... 156/71; 52/265, 266, 52/267, 268, 269; 220/444, 467, 453, 461, 462

[56] References Cited

U.S. PATENT DOCUMENTS

| | | | |
|---|---|---|---|
| 2,293,961 | 9/1942 | Zimmerman . | |
| 2,321,777 | 6/1943 | Schelhammer | 220/461 |
| 2,441,778 | 6/1948 | Traver . | |
| 2,746,891 | 5/1956 | Doane | 156/71 |
| 2,896,271 | 7/1959 | Kloote et al. . | |
| 3,054,523 | 9/1962 | Batzer | 52/269 |
| 3,475,260 | 10/1969 | Stokes | 156/71 |
| 4,378,403 | 3/1983 | Kotcharian | 428/251 |
| 4,428,500 | 1/1984 | Kohler . | |
| 4,490,198 | 12/1984 | Mitchell | 156/71 |
| 4,516,906 | 5/1985 | Krein . | |

*Primary Examiner*—Donald E. Czaja
*Assistant Examiner*—J. Davis
*Attorney, Agent, or Firm*—Christensen, O'Connor, Johnson & Kindness

[57] ABSTRACT

A method for sealing a controlled-atmosphere storage room used for storing fruits and vegetables includes the steps of sealing each three-way corner of the room with a gas-impermeable material, sealing the vertical intersections of the walls with the same gas-impermeable material, sealing the horizontal intersection of wall and floor and wall and ceiling with the same gas-impermeable material, and substantially completely covering each wall and the ceiling with continuous sheets of said gas-impermeable material. The order of sealing the wall and ceiling surfaces and the horizontal and vertical intersections is not critical to the method. A synthetic rubber or chlorosulfonated polyethylene in sheet form is a suitable material.

12 Claims, 7 Drawing Sheets

METHOD FOR SEALING CONTROLLED-ATMOSPHERE STORAGE ROOM

BACKGROUND OF THE INVENTION

Thisinvention relatess to the sstorge offruit and vegtables in warehouses in which the atmosphere surrounding the fruitsand vegtables is controlled tomaintain freshness ofthe fruit and egtables and, more particularly, relatesto a method for sealing the storge room againstthe passage of unwantd gases into or out of thee room.

The present methods of constructing storagerooms that are used in the controlld-atmosphere storage offruits and vegtables use plywood sheets to cover the walls of the room. These methods rsult in a number of lywood seams, both verticaland horizontal, being prsent on the walls and ceiling of the room. In addition to sealing the surfaces of theplywood shets, each of the seams must be individually sealed and is therefore prone to repeated repairs to preventleakage. Typically, the seams between each plywood sheet are sealed with tape and rolled with an elastomeric substance. All surface areasare then sealed by a sprayed-on layer of elastomeric coating. In another method,shets ofhigh-dnsity overlay or mdium-density overlay plywood with an airtight surface manufactured ontoit are installed on the walls. The seams betwen ach plywood sheet are, again, sealaed with a fiber tape and rolld with an lastomeric coating. As can be seen, each of these methods involves a number of seams that must be individually be sealaed against passage of gases into and out of the room, and each sam is then poteentially a site for leakage. It is also necessary to seal each nail hole through which nails are driven to hold the plywood shets in place and, again, ach such individually sealed siteprsents the potential for lakage.

It is threfore an object of this invetion to provide a method of sealing a controlld-atmosphere storage room, which elimintes the need to seal each nail hole and construction joint except for the corner joints. It is also an object ofthis invention to provid a method that minimizes the number of seams in the final sealed room and liminates horizontal seams in the sealing material. The method of the present invention provides a room that can besealed for a longer period of time than by prvious processes without leaks seveloping, to thereby lower maintenance costs and energy cost associated with infiltration of a foreign atmosphere into the storage room.

Another object ofthe present inventionis to provide a method for sealing a storage room in which any punctures orlaks in the seal can be easily identified and repaird.

SUMMARY OF THE INVENTION

In accordnace with the above-stated objects, the present invention provides, in a controlld-stmosphere stoage system for toring fuits and vegtables,including a storage oom, a method for sealing the room against th intrusion or escape of gases. The sealing method includes th steps of first saling the three-way corners of the room with a gas-impermeable material. The remiander ofthe room is then sealed with the same gas-impermeable material. The walls and ceiling ofthe room are substantially completely covered with shets ofthe gas-impermeable material. ach verticalintersection of the walls is sealed with strips ofthe same gas-impermeable material. The horizontal intersections where the wall and floor meet, and where the wall and ceiling meet, are also sealed with strips ofthe gas-impermable material.

In a prferredembodiment the sheets of sealing mateiral are adhesively scured to the walls and seiling of the room before the strips are applied to the horizontal and vertical intersections. However, the order of appliction can be changedto accommodate the particular situation. The use of an identical mateial in all of the sealing procedurs means that the coefficient of expansion of all of the sealing materials will be the same sothat in the event of changes in temperature there willbe uniform xpansion ofthe sealing material. The uniform expansion prevents separation of the sealing mateiral due tounequal expansion, which is the case when nonidentical materials are used adjacent one another in the sealing procss.

BRIEF DESCRIPTION OF THE DRAWINGS

The objects and advantages ofthe prsent invention will be better understood by those of ordinary skill in the art and others upon reading the ensuing specifiction, when taken n conjucntion with thw appnded drawings, wherein.

DESCRIPTION OF THE PREFERRED EMBODIMENT

While the present invention will be described and illustrated in terms of its use in ealing a storage room used in the controlled-atmosphere storage of fruits and vegtables, it should be understood tht the method of the present invention could be used to sel any space from the unwanted intrusion of foreign atmospheres, where the atmosphere within the room is to be controlld. Therefore, the dscription of the prsent invention with relation to th storge of fruits and vegtables isnot intended to be limiting, but is only xemplary of one use ofth method ofthe present invention.

Figure 1:
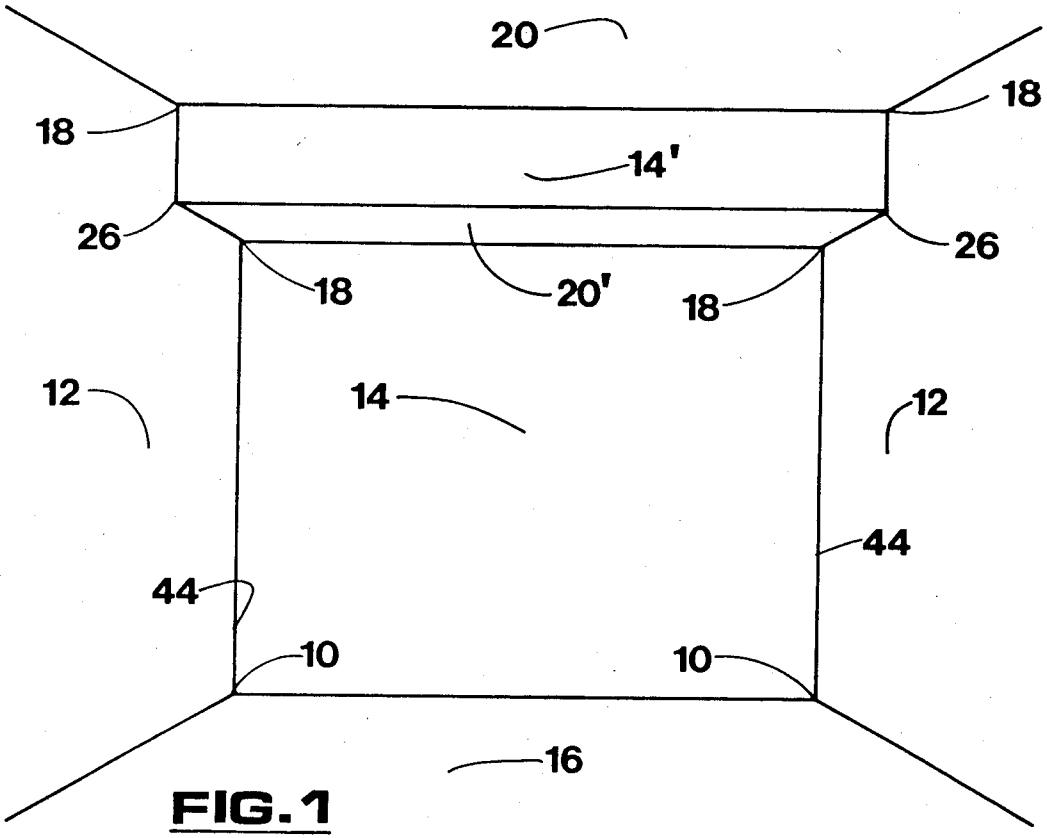
FIG. 1 is an isometric view of a typical storage room with the plywood in place, rady to be sealed.

FIG. 1 is an isometric view of a portion of a typical room used for storge of apples or other produce. Two side walls 12 are shown intersecting a rear wall 14, floor 16, and ceiling 20. To illustrate the use of the present method on a variety of room configurations, the back wall in FIG. 1 is shown as including an upper portion 14' that is forward of the lower portion of the rear wall 14 and intersects with a lowered portion 20' of the ceiling 20 to form a stepped configuration. An inward corner 10 formed at the intersection of walls 12 and 14, and floor 6, is known as a three-way corner, as is the corner 18 formed by the intersection of the walls 14' and 12 and the ceiling 20. A corner 26 formed at the intersection of wall 12 with back wall portion 14' and celing portion 20' is also a three-way corner but will be referred to as an outward corner.

The uncovered walls and ceiling of the storage room are typically made of plywood or some other rigid, sheet-type building material. The method of the present invention requires the application of adhesive to the wall and ceiling surfaces. If untreated plywood is used, there is a tendency for the plywood to adsorb the contact adhesive that is applied to scure the sealing sheet material to the walls and ceiling. The absorption of the adhesive can have a detrimental effect on the economy of the process since more adhesive will ned to be used to compensate for the absorption. Also, the absorption can detrimentally affect the bonding strength of the adhesive, since the dryers in the adhesive can be prematurely drawn into the plywood, causing an abnormal curing rate for the adhesive. Therefore, it is pereferable whn using standard plywood to prime the plywood with, for example, a coat of latex paint prior to applying the adhesive tothe walls and ceiling. Another method, and the preferred method, is to use a pretreated or presealed building material such as medium-density overlay or high-density overlay, which has a substantially less absorptive surface. Since the room will be subjected to changes in pressuredue to atmospheric pressure changes, the wall and ceiling substructure must be as rigid as possible to prevent movement of the structure and eliminate stresses on joints and material that accompany such movement. The room will be subjected to both positive and negative pressures during the course ofits use. It is presumed as a prerequisite to performing the sealing method of the present invention that all of the wall, floor and ceiling surfaces will be suitable for sealing in the sense of being clean, firm surfaces, which have has any dust, grease, films, or moisture removed therefrom.

Figure 2:
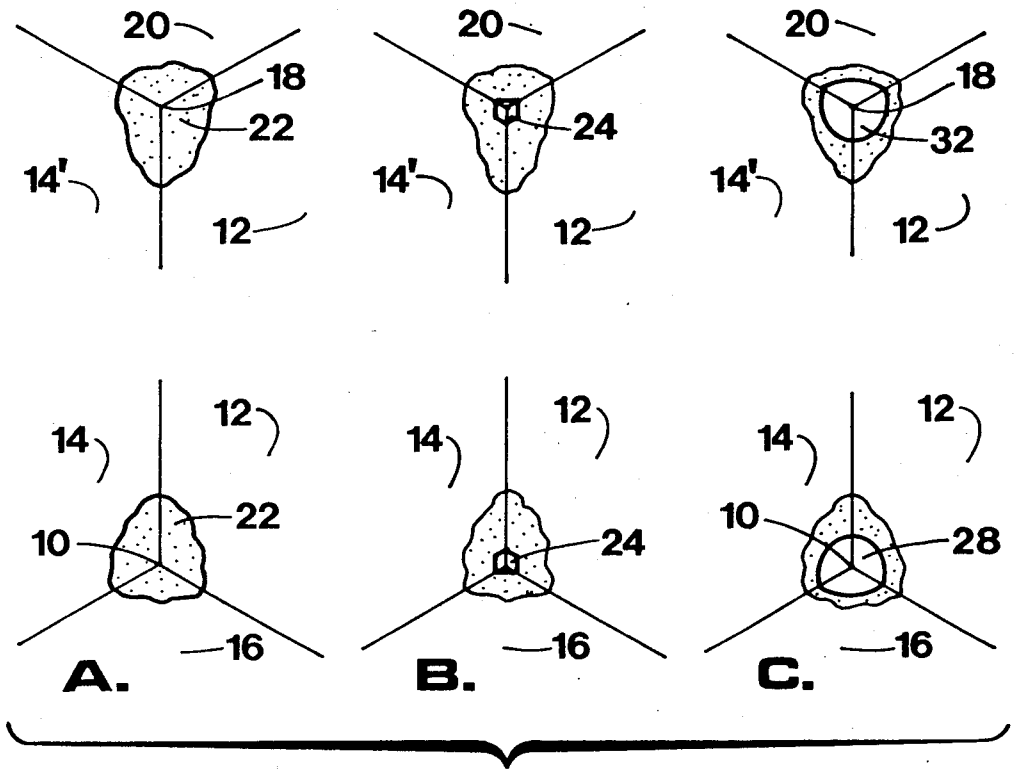
FIGS. 2A, B, and C are isometric view s of a vertical wall intersection of the room and show the sequence ofstepsfor sealing the inward three-way corners of the room in accordance with the principles of the present invention.

The first step in sealing the room accoridng to the present method includes sealing the inward three-way corners, such as at 10 and 18. FIGS. 2A, B, and C are isometric views of a vertical intersection of the walls 12 and 14 with each other and, respectively, the floor 16 and ceiling 20. The corners 10 and 18 are sealed by first coating the inward three-way corner intersection surfaces with a contact-type cement to form a contat cement film 22. A suitable adhesive, although by no means the only one, has been found to be 3M Fastbond 10, sold by the 3M Company of Minneapolis, Minn. A typical size of the area covered by the film will extend six inches in each direction from the corner 10. A small square 24 of a nonpermeable elastomeric material, such as a synthetic rubber, is then adhesively secured to the corner, as shown in FIG. 1B. The square 24 is shown in greater dtail in FIG. 2 and is typically a $\frac{1}{2}'' \times \frac{1}{2}''$ square of material, which is prcoated with contact adhesive and pushed into the corner 10 and rubbed into the contact cement until good adherence ismade. Another piece of material 24 is used to plug the upper three-way corner 18. It has been found that a suitable material is the chlorosulfonated polyethylene elastomer sold by theE.I.Dupont de Nemours Company under the mark HYPALON, as dscribed in monograph 4784 of the Merck Index, 10th Edition. Another suitable material is reinforced HYPALON, which is available in sheet form. Each of the inward three-way corners of the room is similarly plugged with a small square of the gas-impermeable material.

The next step in the sealing process of the prsent invention includes applying contact cement again tothe wall and floor surfaces making up the corner 10 and over the material squar 24, again to a distance about six inches in each direction on the thre surfaces. A circle 28 ofthe sealaing material is formed with a straight slot 30 starting at one edge and proceeding to the center of the circle, as illustrated in detail in FIG. 4A. One side of the circle 28 is coated with contact cement and allowed to dry to a tack-free condition. Circle 28 is then pushed into the corner 10 over the square material 24, and attached to the walls 12 and 14 and the floor 16, as shown in detail in FIGS. 4B andC. On quadrant of the circle 28 is attached to the wall 14 and one quadrant to the floor 16. The two quandrants of the circle 28 that are adjacent the slot 30overlie one anotheer so that one of them is attchd to wall 12 and the other is attached to that quadrant by contact adhesive 50. Once again, a similar circle of material 32 is used to cover the corner 18 in a similar manner. Each of the inward three-way corners is treated in an identical manner to complete the second step of the sealing process.

Figure 5:
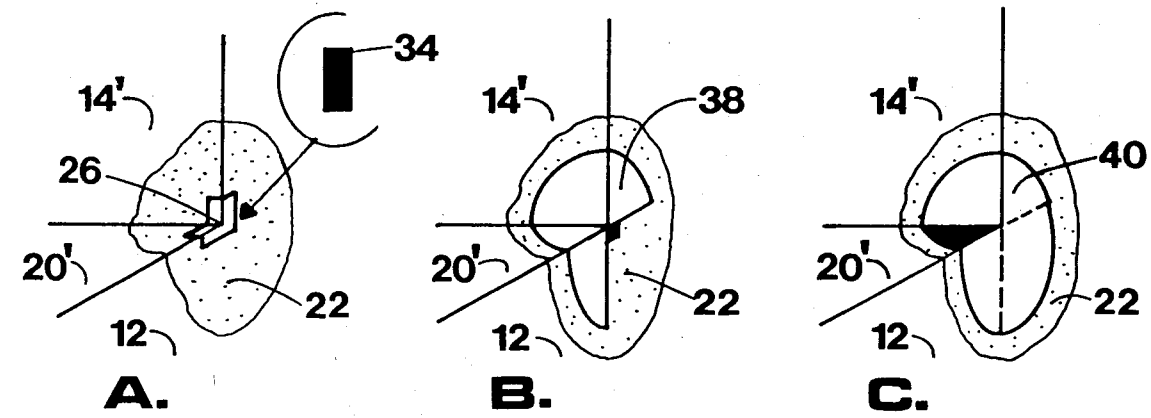
FIGS. 5A, B, and C are isometric views of an outward three-way corner ofthe room showing the sequnce of selaing the outward three-way corner in accordance with the principles of the present invention.

FIG. 5A illustrates the outward corner 26 of the room, which is formed by the wall portion 14', wall 12 and the ceiling portion 20'. In the prefrred method of thepresent invention, ach outward three-way corner is also sealed against the passage of unwanted gases by using the same impermeable material that is used to seal the inward thre-way corners, as describd above. When sealing the outward three-way corners, a rectangular piece 34 of the impermeable material is adhesively scured, as shown in FIG. 5A, to cover the point of intersection ofthe outward three-way corner by first coating the corner with contact cement 36, and then applying the rectangle to the corner as shown in FIG. 5A. The piece is typically about $1'' \times 2''$. Another circular piece 38 of the impermeable material, again with a slot formed therein, is applied tothe surfaces adjacent the outward three-way corner as shown in FIG. 5B to cover the rectangular piece 34, ans also to cover the intersections of the wall portion 14' with wall 12 and ceiling portion 20' immdiately adjacent the outward three-way corner. A second circular pice 40 of the same impermable material, again with a slot formd therin, is placed over the piece 38, but is rotated 180° from the piece 38 so that the slots in thee pieces 38 and 40 do not align themselves. The piece 40 therefore effectively seals the slot in the piece 38 to provide a complete seal for the outward threeway corner. Again, each of thee outward three-way corners of the room is sealed in a similar manner.

After all of the three-way corners have ben sealed as described above, the wall surfaces and ceiling surfaces can now be sealaed. While the precise order of application of material to the walls and ceiling or to th wall intersections can be varied, the preferred method is to next apply seal material to the walls and ceiling of the room. The wall surfaces are sealed by covering each ofthem with shets of the same impermeable material that was used to seal each of the corners, as described above. In an ideal application, each wall surface would be covered by a single preformed continuous sheet of the synthetic rubber material. However, because of handling constraints and the time-limiting effect of the adhsive cure time, it will usuaaly be necessary to apply several sheets of material to cover the wall. The wall surface is first covered with a contact cement to a distance approximately six inches beyond the edges of the sheet. As sen n FIG. 6, a sheet of material 52 is ten overlaid on the wall and adhesively secured by the contact cement. In applying the sheet 52 of material to the wall, it has ben found to be best to start at the top of the wall and work down the wall, along the width of the sheet, by rubbing the sheetiing to assure positve contact adhsion and to eliminate any air bubbles that may be etrapped betwen the shet and the wall surface. Since the room will be subjected to negative pressure at some time, it is necessary to achieve sufficient bonding to the wall to prevent the sheet 52 from being pulled from the wall. The sheet is sized to cover the full vertical length of the wall, thereby eliminating all horizontal seams. When the next sheet 52 of material is ready to be placed on the wall, it is positiond tooverlap the previously placed shet. the area of overlap on both shets is treated with a thinner, such as toluene, the reacts chemically with the synthetic rubber and the adhesive to weld the two overlapping sheets together to form a bond betwen the two sheetsin the overlapped area. A suitable adhesive has ben found to be one sold by the Burke Rubber Company under the designation BR-7000. Such adhesive is referred to herein as "Hypalon adhsive" or "contact joint cement." In this way, after the wall has ben completely coverd, the sealing material forms, in effect, a continuous sheet of material over the wall surface. The use of a sheet 52 of material makes it easy to detct any tears or openings in the material that may lad tolakageafter application. As mentioned earlier, using the same material to cover the walls and to seal the corners provides for equal coefficient of xpansion to ract to temperature changes within the room so that all sealing material expands and contracts in unison, preventing separation at the joints between pieces of material caused by unequal expansion. When all walls have been covered, the ceiling is covered in a similar manner, using sheets 54 of the impermeable material, which cover the ceiling surface toprovide aseal. FIG. 7 illustrates the room with the walls and ceiling covered by sheets 52 and 54.

Figure 8:
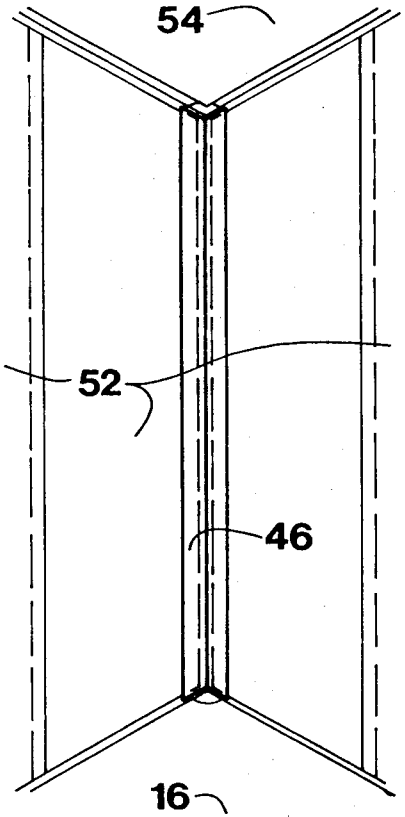
FIG. 8 is an isometric view of a vertical intersection of two walls of the room sealed in accordance with the principles of the present invention.

After each of the walls anad the ceiling of the room are sealed, the method of the present invention contemplates sealing the vertical corners formed by theintersection of the walls of the room. FIG. 8 shows a vertical intersection formed by the walls 12 and 14, which has had sheets 52 and 54 applied. A strip 46 of the impermable material is applied to the vertical corner 44. The strip 46 is wide enough to cover the corner and xtend onto the sheets 52 covering each of the walls 12 and 14. The strip 46 is adhesively secured to the sheets 52 by the contact joint cement, which has previously ben applied. As with the overlap joints betwen sheets 52 it is preferable to use a cement and thinner that reacts with the shet material to chemically weld the strip 46 to the sheets 52. ach of the interior vertical corners of the room is sealed in an identical manner.

Figure 9:
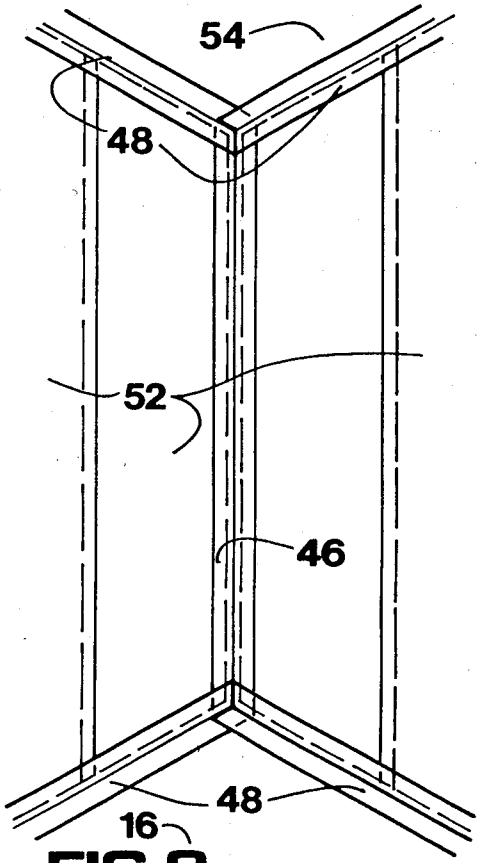
FIG. 9 is an isometric view of the corner shown in FIG. 2 with the horizontal intersections of the wall and ceiling and the wall and floor sealed in accordance with the principles of the present invention.

FIG. 9 shows the sealing of the horizontal corners formd by th intersections of the walls 12 and 14 with the floor 16 and ceiling 20, which must be sealed in a manner similar to the vertical corners, with a strip 48 of the impermable material adhsively secured by a layer of contact joint cement 50 previously applied to the sheets 52 and 54 covering the walls and ceiling, respectivley. Preferably, the strip of material 48 is continuous from ach wall toits opposing wall to provide a continuous seal along the horizontal corner.

Figure 10:
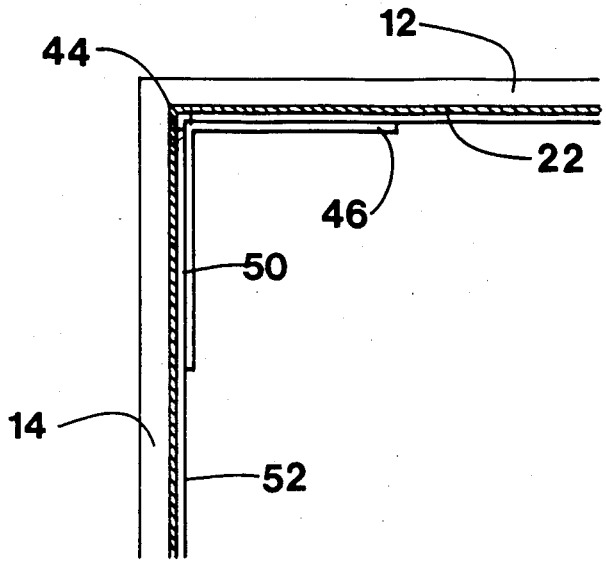
FIG. 10 is a plan view in section of the corner of the room after sealing has ben substantially completed; and, FIG. 11 is a somewhat schematic isometric view of the controlled-atmosphere storage room of FIG. 1 showing th finished seal of the interior of the room in accordance with the principls ofthe present invention.
Figure 11:
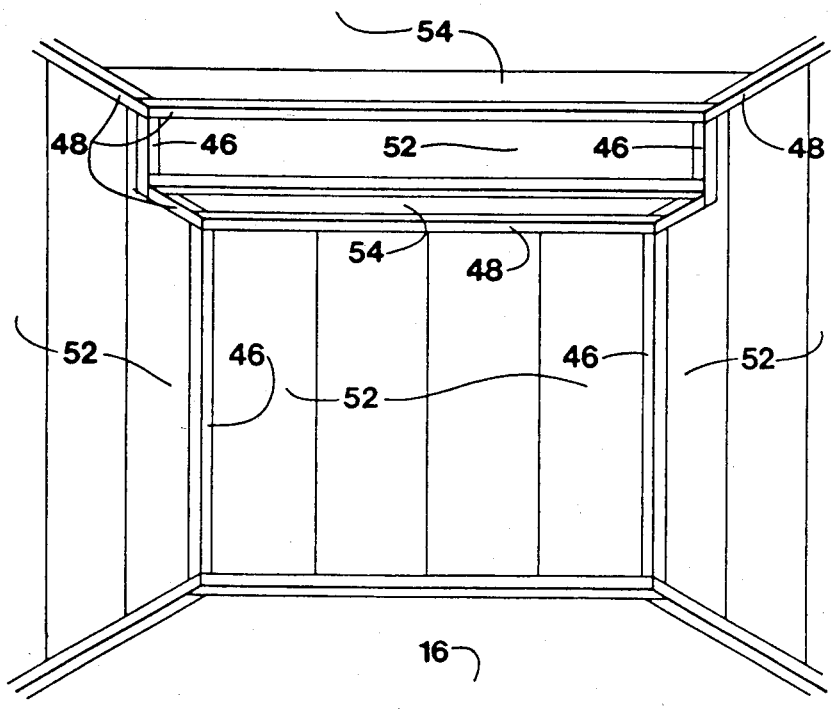

FIG. 10 is a sectional view of the corner 44 betwen walls 12 and 14 which shows the various layers of sealing material that have ben applied to the wallin accordance with the above-described procedure. Once the sealing has been completed, any door openings in the room can be counterflashed in a typical manner and the doors hung to allow the room to be sealed so it can be tested by a pressure test in order to determine whether the seal has been properly completed. FIG. 11 shows a completed room.

A method of sealing a room therefore has ben described, which provides a positive sealin which tears in thesealing material can be easily detected and repaired. While a preferred form of the invention has been described and illustrated, it should be understood by those of ordinary skill in the art and others that several changes can be made to the illustrated and described mbodiment while remaining within the spirit and scope of the present invention. For example, as was discussed, although the sealing method has been described in relation to a controlled-atmosphere storage room for fruits and vegtables, it is suitable for use in any environment where a sealed room or building is required. Also, while certain materials, such as synthetic rubbers, Hypalon, and otheer elastomers have been described as suitable materials, it isnot intended to limit the invntion to those particular materials. Any gas-impermeable sheet material can be used that is flexible and tha can be shaped toconform to the corners as necessary in the first steps of the sealing process. One critical element of the process is the use of n identical material to perform corner sealing and wall and ceiling surface sealing so that the coefficients of expansion are identical to prevent separation of the material at joints due to temperture changes. Also, while the procedure has been described using contact cement to adhere the materials to the wall and ceiling surfaces, it should be understood that other adhesive materials can also be used. Since many changes can be made to the illustrated and dscribed embodiment while remaining within the scope of the invention, the invention should be defined solely with reference to the appnded claims.

The embodiments ofthe invention in whcih an exclusive property or privilege is claimed are defined as follows:

1. A method of sealing a room having a floor, a ceiling, and at least two adjacent walls lying between said floor and said ceiling comprising the steps of:

(a) adhesively securing a square of gas-impermeable sheet material into each three-way corner of said room;

(b) adhesively scuring a patch of said gas-impermeable sheet material larger than said square of material onto the adjacent surfaces making up ach of said three-way corners, overlying said square of material;

(c) adhesively securing sheets of said gas-impermeable material to ach of sid walls and said ceiling of said room, substantially completely covering said-walls and ceiling; and (d) adhesively securing continuous strips of said gas-impermeable sheetmaterial onto said walls and ceiling of said room at the intersection of adjacnet walls and the intersection of the walls and floor and the intersection of the walls and ceiling of the room, ach of said strips overlapping at least a portion of the sheets of material covering each of said adjacent walls or floor or ceiling associated with wach such strip.

2. In a controlled-atmosphere storage system for storing fruits and vegtables including a storage room having a floor, a ceiling, and walls lying betwen said floor and ceiling, a method of sealing said room against the intrusion or escape of gases comprises the steps of:

(a) sealing each three-way corner of said room with gas-impermeable material including the steps of scuring a small square of said material in said corner and then covering said square with a larger piece of material in sheet form such that a portion of said larger piece is adhesively secured to each adjacent surface making up said corner;

(b) sealing ech vertical intersection of walls with said gas-impermaeable material;

(c) sealing each horizontal intersection of wall and floor and ceiling with said gas-impermeable material;

(d) substantially completely covering each wall with a continuous sheet of said gas-impermeable material; and (e) substantially completely covering said ceiling with a continuous shet of said gas-impermeable material.

3. The method of claim 2, wherein said vertical intersection sealing step includes adhesively securing a continuous strip of said material in sheet form to the walls adjacent each vertical intersectuion.

4. The mthod of claim 3, wherein said horizontal intersection sealing step includes adhesively securing a continuous strip of said material in sheet form to said wall and floor and said wall and ceiling adjacent ach said horizontal intersection.

5. the method of claim 4, wherein said continuous sheet attached to each wall overlaps a portion of said strips associated with that wall.

6. The method of claim 1, wherein said gas-impermeable material is chlorosulfanated polyethylne

7. the method of claim 2, whrein said material is chlorosulfonated polyethylene

8. The method of claim 2, wheein said material is a synthetic rubber.

9. The method of claim 2, wherein siad continous sheet of material is preformed prior to application to said wall.

10. the method of claim 2, further including the steps of forming said continuous sheets on said walls and ceiling by applying strips of said material to said wall in overlapping configurration and chemically welding said overlapping portions of adjacent strips to one antoher.

11. The method of claim 10, whrein said strips are applied in lengths equal to the vertical height of said walls so as to eliminate horizontal seams.

12. The method of claim 2, further including the step of priming said walls and ceiling prior to the placement of said shets of mateeial on said walls and ceiling to decrease the absorptiveness of said walls and ceiling.

* * * * *

UNITED STATES PATENT AND TRADEMARK OFFICE

CERTIFICATE OF CORRECTION

PATENT NO. : 4,744,840

DATED : May 17, 1988

INVENTOR(S) : Michael J. Addleman

It is certified that error appears in the above-identified patent and that said Letters Patent is hereby corrected as shown below:

Columns 1-8 should be deleted to appear as per attached columns 1-8.

Signed and Sealed this

Twenty-sixth Day of December, 1989

*Attest:*

JEFFREY M. SAMUELS

*Attesting Officer*

*Acting Commissioner of Patents and Trademarks*

METHOD FOR SEALING CONTROLLED-ATMOSPHERE STORAGE ROOM

BACKGROUND OF THE INVENTION

This invention relates to the storage of fruit and vegetables in warehouses in which the atmosphere surrounding the fruits and vegetables is controlled to maintain freshness of the fruit and vegetables and, more particularly, relates to a method for sealing the storage room against the passage of unwanted gases into or out of the room.

The present methods of constructing storage rooms that are used in the controlled-atmosphere storage of fruits and vegetables use plywood sheets to cover the walls of the room. These methods result in a number of plywood seams, both vertical and horizontal, being present on the walls and ceiling of the room. In addition to sealing the surfaces of the plywood sheets, each of the seams must be individually sealed and is therefore prone to repeated repairs to prevent leakage. Typically, the seams between each plywood sheet are sealed with tape and rolled with an elastomeric substance. All surface areas are then sealed by a sprayed-on layer of elastomeric coating. In another method, sheets of high-density overlay or medium-density overlay plywood with an airtight surface manufactured onto it are installed on the walls. The seams between each plywood sheet are, again, sealed with a fiber tape and rolled with an elastomeric coating. As can be seen, each of these methods involves a number of seams that must individually be sealed against passage of gases into and out of the room, and each seam is then potentially a site for leakage. It is also necessary to seal each nail hole through which nails are driven to hold the plywood sheets in place and, again, each such individually sealed site presents the potential for leakage.

It is therefore an object of this invention to provide a method of sealing a controlled-atmosphere storage room, which eliminates the need to seal each nail hole and construction joint except for the corner joints. It is also an object of this invention to provide a method that minimizes the number of seams in the final sealed room and eliminates horizontal seams in the sealing material. The method of the present invention provides a room that can be sealed for a longer period of time than by previous processes without leaks developing, to thereby lower maintenance costs and energy costs associated with infiltration of a foreign atmosphere into the storage room.

Another object of the present invention is to provide a method for sealing a storage room in which any punctures or leaks in the seal can be easily identified and repaired.

SUMMARY OF THE INVENTION

In accordance with the above-stated objects, the present invention provides, in a controlled-atmosphere storage system for storing fruits and vegetables, including a storage room, a method for sealing the room against the intrusion or escape of gases. The sealing method includes the steps of first sealing the three-way corners of the room with a gas-impermeable material. The remainder of the room is then sealed with the same gas-impermeable material. The walls and ceiling of the room are substantially completely covered with sheets of the gas-impermeable material. Each vertical intersection of the walls is sealed with strips of the same gas-impermeable material. The horizontal intersections where the wall and floor meet, and where the wall and ceiling meet, are also sealed with strips of the gas-impermeable material.

In a preferred embodiment the sheets of sealing material are adhesively secured to the walls and ceiling of the room before the strips are applied to the horizontal and vertical intersections. However, the order of application can be changed to accommodate the particular situation. The use of an identical material in all of the sealing procedures means that the coefficient of expansion of all of the sealing materials will be the same so that in the event of changes in temprature there will be uniform expansion of the sealing material. The uniform expansion prevents separation of the sealing material due to unequal expansion, which is the case when non-identical materials are used adjacent one another in the sealing process.

BRIEF DESCRIPTION OF THE DRAWINGS

Figure 3:
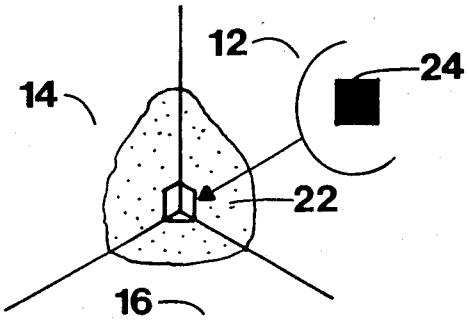
FIG. 3 is an isometric view ofon inward three-way corner of FIG. 2 showing the details ofsealing in accordance with the method of thee present invention.
Figure 4:
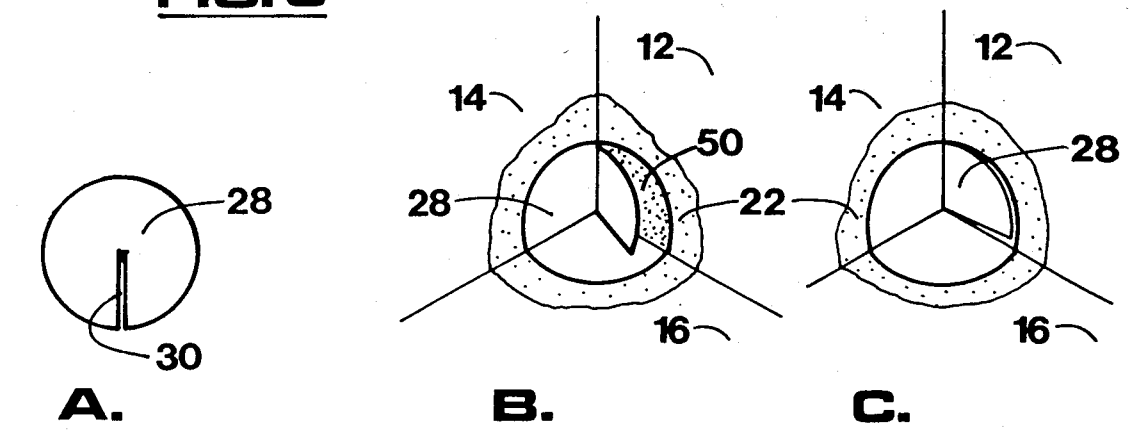
FIGS. 4A, B, and C are somewhat schematic views illustrating a second step in the sealing of the inside corners according to the method of the present invention.
Figure 6:
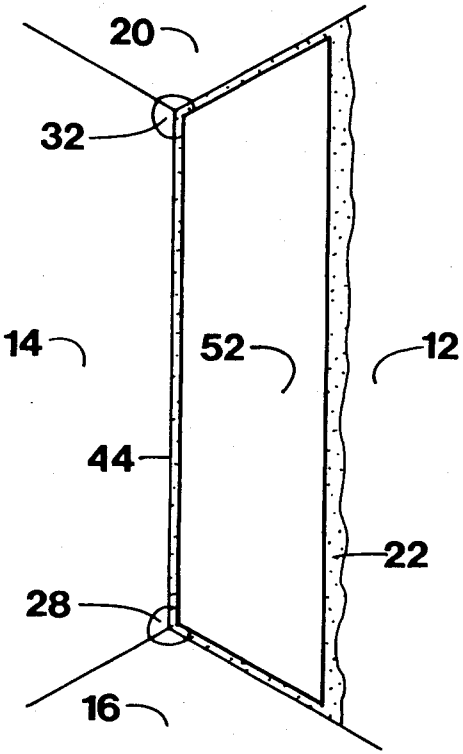
FIG. 6 is an isometric view ofthe verticalwall intersection of the room shown in FIG. 2 having a wall sealed in accordance with thee principles of the present invention.
Figure 7:
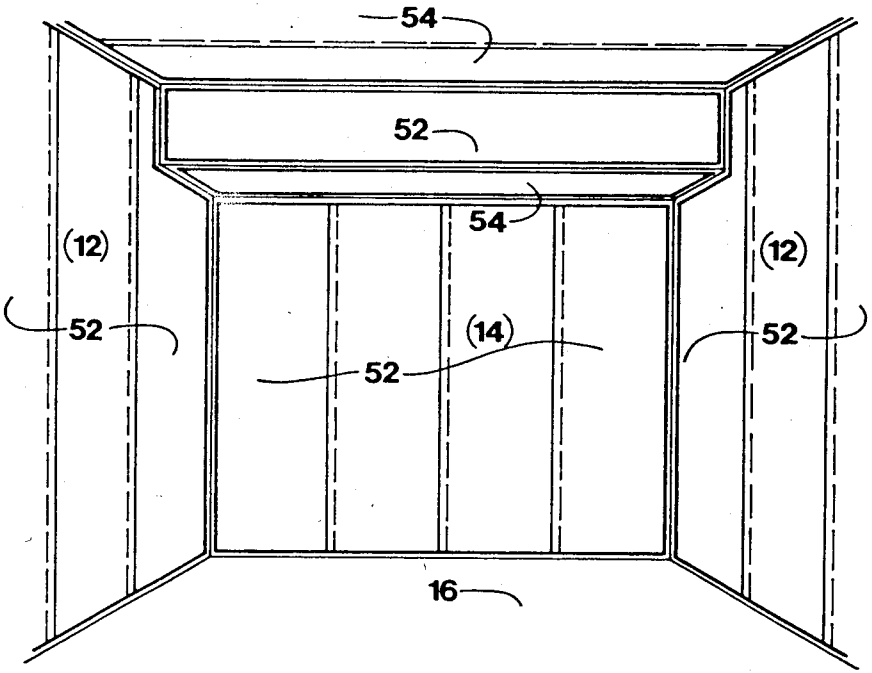
FIG. 7 is an isometric view of the room of FIG. 1 with sealing material affixed to the walls and ceiling.

The objects and advantages of the present invention will be better understood by those of ordinary skill in the art and others upon reading the ensuing specification, when taken in conjunction with the appended drawings, wherein:

FIG. 1 is an isometric view of a typical storage room with the plywood in place, ready to be sealed;

FIGS. 2A, B, and C are isometric views of a vertical wall intersection of the room and show the sequence of steps for sealing the inward three-way corners of the room in accordance with the principles of the present invention;

FIG. 3 is an isometric view of one inward three-way corner of FIG. 2 showing the details of sealing in accordance with the method of the present invention;

FIGS. 4A, B, and C are somewhat schematic views illustrating a second step in the sealing of the inside corners according to the method of the present invention;

FIGS. 5A, B, and C are isometric views of an outward three-way corner of the room showing the sequence of sealing the outward three-way corner in accordance with the principles of the present invention;

FIG. 6 is an isometric view of the vertical wall intersection of the room shown in FIG. 2 having a wall sealed in accordance with the principles of the present invention;

FIG. 7 is an isometric view of the room of FIG. 1 with sealing material affixed to the walls and ceiling;

FIG. 8 is an isometric view of a vertical intersection of two walls of the room sealed in accordance with the principles of the present invention;

FIG. 9 is an isometric view of the corner shown in FIG. 2 with the horizontal intersections of the wall and ceiling and the wall and floor sealed in accordance with the principles of the present invention;

FIG. 10 is a plan view in section of the corner of the room after sealing has been substantially completed; and, FIG. 11 is a somewhat schematic isometric view of the controlled-atmosphere storage room of FIG. 1 showing the finished seal of the interior of the room in accordance with the principles of the present invention.

DESCRIPTION OF THE PREFERRED EMBODIMENT

While the present invention will be described and illustrated in terms of its use in sealing a storage room used in the controlled-atmosphere storage of fruits and vegetables, it should be understood that the method of the present invention could be used to seal any space from the unwanted intrusion of foreign atmospheres, where the atmosphere within the room is to be controlled. Therefore, the description of the present invention with relation to the storage of fruits and vegetables is not intended to be limiting, but is only exemplary of one use of the method of the present invention.

FIG. 1 is an isometric view of a portion of a typical room used for storage of apples or other produce. Two side walls 12 are shown intersecting a rear wall 14, floor 16, and ceiling 20. To illustrate the use of the present method on a variety of room configurations, the back wall in FIG. 1 is shown as including an upper portion 14' that is forward of the lower portion of the rear wall 14 and intersects with a lowered portion 20' of the ceiling 20 to form a stepped configuration. An inward corner 10 formed at the intersection of walls 12 and 14, and floor 16, is known as a three-way corner, as is the corner 18 formed by the intersection of the walls 14' and 12 and the ceiling 20. A corner 26 formed at the intersection of wall 12 with back wall portion 14' and ceiling portion 20' is also a three-way corner but will be referred to as an outward corner.

The uncovered walls and ceiling of the storage room are typically made of plywood or some other rigid, sheet-type building material. The method of the present invention requires the application of adhesive to the wall and ceiling surfaces. If untreated plywood is used, there is a tendency for the plywood to absorb the contact adhesive that is applied to secure the sealing sheet material to the walls and ceiling. The absorption of the adhesive can have a detrimental effect on the economy of the process since more adhesive will need to be used to compensate for the absorption. Also, the absorption can detrimentally affect the bonding strength of the adhesive, since the dryers in the adhesive can be prematurely drawn into the plywood, causing an abnormal curing rate for the adhesive. Therefore, it is preferable when using standard plywood to prime the plywood with, for example, a coat of latex paint prior to applying the adhesive to the walls and ceiling. Another method, and the preferred method, is to use a pretreated or presealed building material such as medium-density overlay or high-density overlay, which has a substantially less absorptive surface. Since the room will be subjected to changes in pressure due to atmospheric pressure changes, the wall and ceiling substructure must be as rigid as possible to prevent movement of the structure and eliminate stresses on joints and material that accompany such movement. The room will be subjected to both positive and negative pressures during the course of its use. It is presumed as a prerequisite to performing the sealing method of the present invention that all of the wall, floor and ceiling surfaces will be suitable for sealing in the sense of being clean, firm surfaces, which have had any dust, grease, films, or moisture removed therefrom.

The first step in sealing the room according to the present method includes sealing the inward three-way corners, such as at 10 and 18. FIGS. 2A, B, and C are isometric views of a vertical intersection of the walls 12 and 14 with each other and, respectively, the floor 16 and ceiling 20. The corners 10 and 18 are sealed by first coating the inward three-way corner intersection surfaces with a contact-type cement to form a contact cement film 22. A suitable adhesive, although by no means the only one, has been found to be 3M Fastbond 10, sold by the 3M Company of Minneapolis, Minn. A typical size of the area covered by the film will extend six inches in each direction from the corner 10. A small square 24 of a nonpermeable elastomeric material, such as a synthetic rubber, is then adhesively secured to the corner, as shown in FIG. 1B. The square 24 is shown in greater detail in FIG. 2 and is typically a ½"×½" square of material, which is precoated with contact adhesive and pushed into the corner 10 and rubbed into the contact cement until good adherence is made. Another piece of material 24 is used to plug the upper three-way corner 18. It has been found that a suitable material is the chlorosulfonated polyethylene elastomer sold by the E. I. Dupont de Nemours Company under the mark HYPALON, as described in monograph 4784 of the Merck Index, 10th Edition. Another suitable material is reinforced HYPALON, which is available in sheet form. Each of the inward three-way corners of the room is similarly plugged with a small square of the gas-impermeable material.

The next step in the sealing process of the present invention includes applying contact cement again to the wall and floor surfaces making up the corner 10 and over the material square 24, again to a distance about six inches in each direction on the three surfaces. A circle 28 of the sealing material is formed with a straight slot 30 starting at one edge and proceeding to the center of the circle, as illustrated in detail in FIG. 4A. One side of the circle 28 is coated with contact cement and allowed to dry to a tack-free condition. Circle 28 is then pushed into the corner 10 over the square material 24, and attached to the walls 12 and 14 and the floor 16, as shown in detail in FIGS. 4B and C. One quadrant of the circle 28 is attached to the wall 14 and one quadrant to the floor 16. The two quadrants of the circle 28 that are adjacent the slot 30 overlie one another so that one of them is attached to wall 12 and the other is attached to that quadrant by contact adhesive 50. Once again, a similar circle of material 32 is used to cover the corner 18 in a similar manner. Each of the inward three-way corners is treated in an identical manner to complete the second step of the sealing process.

FIG. 5A illustrates the outward corner 26 of the room, which is formed by the wall portion 14', wall 12 and the ceiling portion 20'. In the preferred method of the present invention, each outward three-way corner is also sealed against the passage of unwanted gases by using the same impermeable material that is used to seal the inward three-way corners, as described above. When sealing the outward three-way corners, a rectangular piece 34 of the impermeable material is adhesively secured, as shown in FIG. 5A, to cover the point of intersection of the outward three-way corner by first coating the corner with contact cement 36, and then applying the rectangle to the corner as shown in FIG. 5A. The piece is typically about 1"×2". Another circular piece 38 of the impermeable material, again with a slot formed therein, is applied to the surfaces adjacent the outward three-way corner as shown in FIG. 5B to cover the rectangular piece 34, and also to cover the intersections of the wall portion 14' with wall 12 and ceiling portion 20' immediately adjacent the outward three-way corner. A second circular piece 40 of the same impermeable material, again with a slot formed therein, is placed over the piece 38, but is rotated 180° from the piece 38 so that the slots in the pieces 38 and 40 do not align themselves. The piece 40 therefore effectively seals the slot in the piece 38 to provide a complete seal for the outward three-way corner. Again, each of the outward three-way corners of the room is sealed in a similar manner.

After all of the three-way corners have been sealed as described above, the wall surfaces and ceiling surfaces can now be sealed. While the precise order of application of material to the walls and ceiling or to the wall intersections can be varied, the preferred method is to next apply seal material to the walls and ceiling of the room. The wall surfaces are sealed by covering each of them with sheets of the same impermeable material that was used to seal each of the corners, as described above. In an ideal application, each wall surface would be covered by a single preformed continuous sheet of the synthetic rubber material. However, because of handling constraints and the time-limiting effect of the adhesive cure time, it will usually be necessary to apply several sheets of material to cover the wall. The wall surface is first covered with a contact cement to a distance approximately six inches beyond the edges of the sheet. As seen in FIG. 6, a sheet of material 52 is then overlaid on the wall and adhesively secured by the contact cement. In applying the sheet 52 of material to the wall, it has been found to be best to start at the top of the wall and work down the wall, along the width of the sheet, by rubbing the sheeting to assure positive contact adhesion and to eliminate any air bubbles that may be trapped between the sheet and the wall surface. Since the room will be subjected to negative pressure at some time, it is necessary to achieve sufficient bonding to the wall to prevent the sheet 52 from being pulled from the wall. The sheet is sized to cover the full vertical length of the wall, thereby eliminating all horizontal seams. When the next sheet 52 of material is ready to be placed on the wall, it is positioned to overlap the previously placed sheet. The area of overlap on both sheets is treated with a thinner, such as toluene, that reacts chemically with the synthetic rubber and the adhesive to weld the two overlapping sheets together to form a bond between the two sheets in the overlapped area. A suitable adhesive has been found to be one sold by the Burke Rubber Company under the designation BR-7000. Such adhesive is referred to herein as "Hypalon adhesive" or "contact joint cement." In this way, after the wall has been completely covered, the sealing material forms, in effect, a continuous sheet of material over the wall surface. The use of a sheet 52 of material makes it easy to detect any tears or openings in the material that may lead to leakage after application. As mentioned earlier, using the same material to cover the walls and to seal the corners provides for equal coefficient of expansion to react to temperature changes within the room so that all sealing material expands and contracts in unison, preventing separation at the joints between pieces of material caused by unequal expansion. When all walls have been covered, the ceiling is covered in a similar manner, using sheets 54 of the impermeable material, which cover the ceiling surface to provide a seal. FIG. 7 illustrates the room with the walls and ceiling covered by sheets 52 and 54.

After each of the walls and the ceiling of the room are sealed, the method of the present invention contemplates sealing the vertical corners formed by the intersection of the walls of the room. FIG. 8 shows a vertical intersection formed by the walls 12 and 14, which has had sheets 52 and 54 applied. A strip 46 of the impermeable material is applied to the vertical corner 44. The strip 46 is wide enough to cover the corner and extend onto the sheets 52 covering each of the walls 12 and 14. The strip 46 is adhesively secured to the sheets 52 by the contact joint cement, which has previously been applied. As with the overlap joints between sheets 52 it is preferable to use a cement and thinner that reacts with the sheet material to chemically weld the strip 46 to the sheets 52. Each of the interior vertical corners of the room is sealed in an identical manner.

FIG. 9 shows the sealing of the horizontal corners formed by the intersections of the walls 12 and 14 with the floor 16 and ceiling 20, which must be sealed in a manner similar to the vertical corners, with a strip 48 of the impermeable material adhesively secured by a layer of contact joint cement 50 previously applied to the sheets 52 and 54 covering the walls and ceiling, respectively. Preferably, the strip of material 48 is continuous from each wall to its opposing wall to provide a continuous seal along the horizontal corner.

FIG. 10 is a sectional view of the corner 44 between walls 12 and 14 which shows the various layers of sealing material that have been applied to the wall in accordance with the above-described procedure. Once the sealing has been completed, any door openings in the room can be counterflashed in a typical manner and the doors hung to allow the room to be sealed so it can be tested by a pressure test in order to determine whether the seal has been properly completed. FIG. 11 shows a completed room.

A method of sealing a room therefore has been described, which provides a positive seal in which tears in the sealing material can be easily detected and repaired. While a preferred form of the invention has been described and illustrated, it should be understood by those of ordinary skill in the art and others that several changes can be made to the illustrated and described embodiment while remaining within the spirit and scope of the present invention. For example, as was discussed, although the sealing method has been described in relation to a controlled-atmosphere storage room for fruits and vegetables, it is suitable for use in any environment where a sealed room or building is required. Also, while certain materials, such as synthetic rubbers, Hypalon, and other elastomers have been described as suitable materials, it is not intended to limit the invention to those particular materials. Any gas-impermeable sheet material can be used that is flexible and that can be shaped to conform to the corners as necessary in the first steps of the sealing process. One critical element of the process is the use of an identical material to perform corner sealing and wall and ceiling surface sealing so that the coefficients of expansion are identical to prevent separation of the material at joints due to temperature changes. Also, while the procedure has been described using contact cement to adhere the materials to the wall and ceiling surfaces, it should be understood that other adhesive materials can also be used. Since many changes can be made to the illustrated and described embodiment while remaining within the scope of the invention, the invention should be defined solely with reference to the appended claims.

The embodiments of the invention in which an exclusive property or privilege is claimed are defined as follows:

1. A method of sealing a room having a floor, a ceiling, and at least two adjacent walls lying between said floor and said ceiling comprising the steps of:

(a) adhesively securing a square of gas-impermeable sheet material into each three-way corner of said room;

(b) adhesively securing a patch of said gas-impermeable sheet material larger than said square of material onto the adjacent surfaces making up each of said three-way corners, overlying said square of material;

(c) adhesively securing sheets of said gas-impermeable material to each of said walls and said ceiling of said room, substantially completely covering said walls and ceiling; and (d) adhesively securing continuous strips of said gas-impermeable sheet material onto said walls and ceiling of said room at the intersection of adjacent walls and the intersection of the walls and floor and the intersection of the walls and ceiling of the room, each of said strips overlapping at least a portion of the sheets of material covering each of said adjacent walls or floor or ceiling associated with each such strip.

2. In a controlled-atmosphere storage system for storing fruits and vegetables including a storage room having a floor, a ceiling, and walls lying between said floor and ceiling, a method of sealing said room against the intrusion or escape of gases comprises the steps of:

(a) sealing each three-way corner of said room with a gas-impermeable material including the steps of securing a small square of said material in said corner and then covering said square with a larger piece of material in sheet form such that a portion of said larger piece is adhesively secured to each adjacent surface making up said corner;

(b) sealing each vertical intersection of walls with said gas-impermeable material;

(c) sealing each horizontal intersection of wall and floor and wall and ceiling with said gas-impermeable material;

(d) substantially completely covering each wall with a continuous sheet of said gas-impermeable material; and (e) substantially completely covering said ceiling with a continuous sheet of said gas-impermeable material.

3. The method of claim 2, wherein said vertical intersection sealing step includes adhesively securing a continuous strip of said material in sheet form to the walls adjacent each vertical intersection.

4. The method of claim 3, wherein said horizontal intersection sealing step includes adhesively securing a continuous strip of said material in sheet form to said wall and floor and said wall and ceiling adjacent each said horizontal intersection.

5. The method of claim 4, wherein said continuous sheet attached to each wall overlaps a portion of said strips associated with that wall.

6. The method of claim 1, wherein said gas-impermeable material is chlorosulfonated polyethylene.

7. The method of claim 2, wherein said material is chlorosulfonated polyethylene.

8. The method of claim 2, wherein said material is a synthetic rubber.

9. The method of claim 2, wherein said continuous sheet of material is preformed prior to application to said wall.

10. The method of claim 2, further including the steps of forming said continuous sheets on said walls and ceiling by applying strips of said material to said wall in overlapping configuration and chemically welding said overlapping portions of adjacent strips to one another.

11. The method of claim 10, wherein said strips are applied in lengths equal to the vertical height of said walls so as to eliminate horizontal seams.

12. The method of claim 2, further including the step of priming said walls and ceiling prior to the placement of said sheets of material on said walls and ceiling to decrease the absorptiveness of said walls and ceiling.

* * * * *